US011413890B2

(12) United States Patent
Nozawa et al.

(10) Patent No.: US 11,413,890 B2
(45) Date of Patent: Aug. 16, 2022

(54) PRINTING APPARATUS

(71) Applicant: CANON KABUSHIKI KAISHA, Tokyo (JP)

(72) Inventors: Hideyuki Nozawa, Tochigi (JP); Tomohiro Suzuki, Kanagawa (JP); Naoki Wakayama, Kanagawa (JP); Ryutaro Takahashi, Tokyo (JP); Masakazu Nagashima, Kanagawa (JP); Waichiro Saiki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/322,062

(22) Filed: May 17, 2021

(65) Prior Publication Data

US 2021/0362521 A1 Nov. 25, 2021

(30) Foreign Application Priority Data

May 22, 2020 (JP) ..... JP2020-089932

(51) Int. Cl.
*B41J 11/66* (2006.01)

(52) U.S. Cl.
CPC ..... *B41J 11/663* (2013.01)

(58) Field of Classification Search
CPC ..... B41J 11/663; B41J 11/66; B41J 11/70
See application file for complete search history.

(56) References Cited

U.S. PATENT DOCUMENTS

2013/0101329 A1* 4/2013 Kanazawa ..... B26D 7/32 400/621
2014/0307019 A1* 10/2014 Muro ..... B41J 11/46 347/16
2014/0307020 A1* 10/2014 Toriihara ..... B41J 11/46 347/16

FOREIGN PATENT DOCUMENTS

JP 2009-220498 A 10/2009

* cited by examiner

*Primary Examiner* — Scott A Richmond
(74) *Attorney, Agent, or Firm* — Canon U.S.A., Inc. I.P. Division

(57) ABSTRACT

A printing apparatus, having a printing unit, includes a first holding unit, a conveyance unit, a first cutting unit arranged between the printing unit and the first holding unit, a second cutting unit arranged between the printing unit and the first cutting unit, and a control unit. The first holding unit holds a sheet. The conveyance unit conveys the sheet to the printing unit. The first cutting unit cuts the sheet fed from the first holding unit. The second cutting unit cuts the sheet fed from the first holding unit. The control unit determines, in accordance with a length in a conveyance direction of a product to be printed on the sheet by the printing unit, whether to cut the sheet fed from the first holding unit by the first cutting unit or the second cutting unit.

10 Claims, 6 Drawing Sheets

PRINTING APPARATUS

BACKGROUND

Field

The present disclosure relates mainly to a printing apparatus.

Description of the Related Art

Among printing apparatuses, there is a printing apparatus that includes a plurality of storage units for storing long sheets and supplies a sheet from one of the plurality of storage units (see Japanese Patent Laid-Open No. 2009-220498). In such a printing apparatus, a cutter that is to be used in a trimming process for cutting a sheet before conveyance is included in each of the plurality of storage units. In addition, when it has been confirmed that a sheet has been conveyed by a only a printing length from the leading edge of the sheet, a cutter of a storage unit that is closest to the printing position on the conveyance path will also perform a cutting process of cutting the sheet in accordance with the sheet size.

Although the cutter of the storage unit that is closest to the printing position on the conveyance path is used for the trimming process and the cutting process of a sheet in accordance with the sheet size, a cutter of a storage unit that is different from the storage unit which is closest to the printing position on the conveyance path will be used for only the trimming process. Since the cutter of the storage unit closest to the printing position is used at a comparatively high frequency, the life of the cutter is short and paper powder easily accumulates in the storage unit.

SUMMARY

An aspect of the present disclosure relates to a printing apparatus that includes a printing unit, cutting units, and a control unit to switch between using a first cutting unit or a second cutting unit.

A feature of the present disclosure is to provide a printing apparatus in which a bias in a usage frequency of a plurality of cutters has been reduced.

According to an aspect of the present disclosure, a printing apparatus having a printing unit includes a first holding unit configured to hold a sheet, a conveyance unit configured to convey the sheet to the printing unit, a first cutting unit arranged between the printing unit and the first holding unit and configured to cut the sheet fed from the first holding unit, a second cutting unit arranged between the printing unit and the first cutting unit and configured to cut the sheet fed from the first holding unit, and a control unit configured to determine, in accordance with a length in a conveyance direction of a product to be printed on the sheet by the printing unit, whether to cut the sheet fed from the first holding unit by the first cutting unit or the second cutting unit.

Further features of the present disclosure will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the disclosure and, together with the description, serve to explain the principles of the disclosure.

DESCRIPTION OF THE EMBODIMENTS

Figure 1:
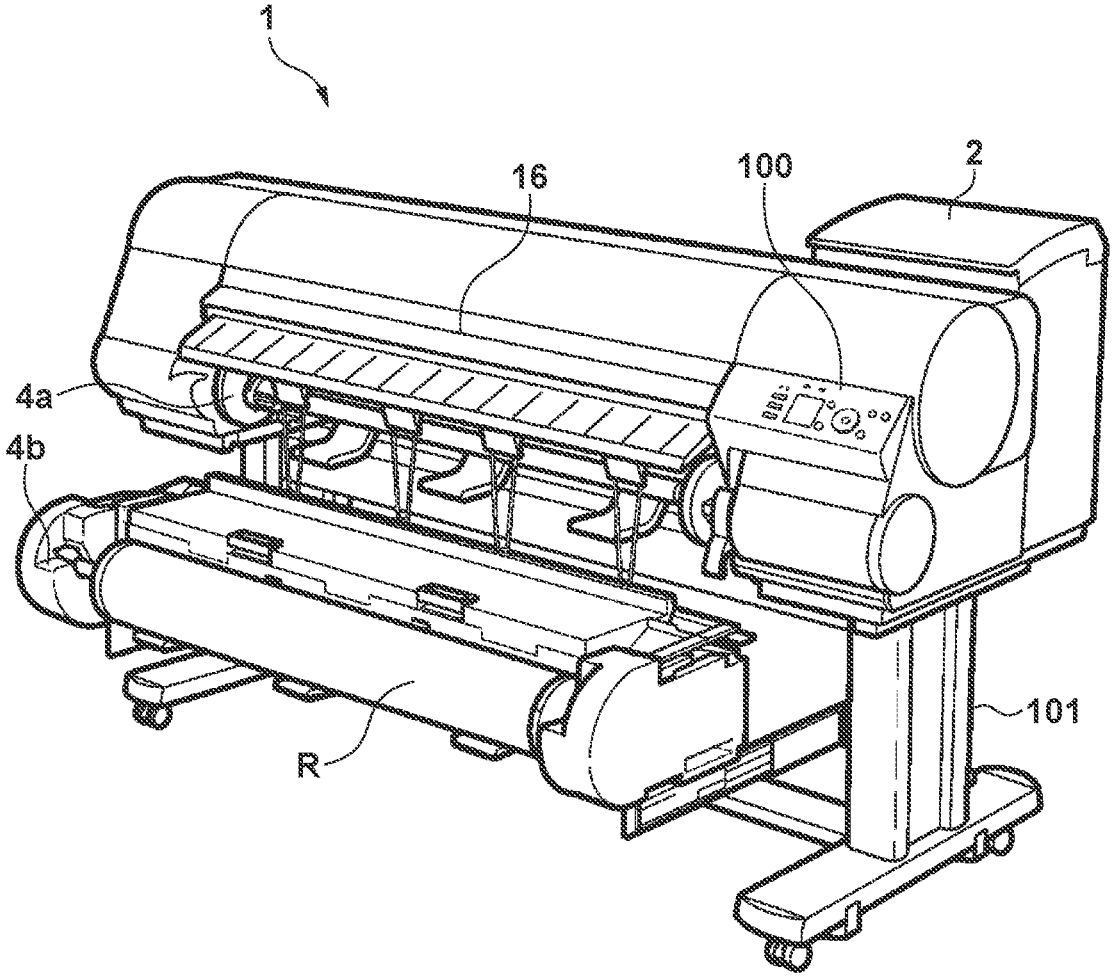
FIG. 1 is an outer perspective view showing the schematic arrangement of an inkjet printing apparatus according to a representative embodiment of the present disclosure.

Hereinafter, embodiments will be described in detail with reference to the attached drawings. Note, the following embodiments are not intended to limit the scope of the disclosure. Multiple features are described in the embodiments, but limitation is not made that requires all such features, and multiple such features may be combined as appropriate. Furthermore, in the attached drawings, the same reference numerals are given to the same or similar configurations, and redundant description thereof is omitted.

Note that in this specification, the term "printing" (to be also referred to as "print" hereinafter) not only includes the formation of significant information such as characters and graphics, regardless of whether they are significant or insignificant. Furthermore, it broadly includes the formation of images, figures, patterns, and the like on a print medium, or the processing of the medium, regardless of whether they are so visualized as to be visually perceivable by humans.

In addition, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be extensively interpreted similarly to the definition of "printing (print)" described above. That is, "ink" includes a liquid which, when applied onto a print medium, can form images, figures, patterns, and the like, can process the print medium, or can process ink (for example, solidify or insolubilize a coloring material contained in ink applied to the print medium).

Further, a "nozzle" generically means an orifice or a liquid channel communicating with it, and an element for generating energy used to discharge ink, unless otherwise specified.

A substrate for a printhead (head substrate) used below means not merely a base made of a silicon semiconductor, but a configuration in which elements, wirings, and the like are arranged.

Further, "on the substrate" means not merely "on an element substrate", but even "the surface of the element substrate" and "inside the element substrate near the surface". In the present disclosure, "built-in" means not merely arranging respective elements as separate members on the base surface, but integrally forming and manufacturing respective elements on an element substrate by a semiconductor circuit manufacturing process or the like.

<Outline of Printing Apparatus (FIG. 1)>

FIG. 1 is a schematic perspective view of an inkjet printing apparatus (to be referred to as a printing apparatus hereinafter) according to a representative embodiment of the present disclosure.

As shown in FIG. 1, a printing apparatus 1 is provided with an operation panel 100 for setting various kinds of settings related to printing and displaying the state of the apparatus. In addition, the printing apparatus 1 is supported by a stand 101, and its printing unit is normally covered by a cover 16 that can open and close. Furthermore, the printing apparatus 1 includes an ink tank cover 2 that is operated when an ink tank is to be replaced. As will be described later, the printing apparatus 1 includes a full-line printhead (to be referred to as a printhead hereinafter) that has a printing width corresponding to a width direction of a print medium and prints an image by discharging ink droplets on the print medium.

The printhead is formed by four color printheads for black (K), cyan (C), magenta (M), and yellow (Y) that have the same arrangement. Hence, four ink tanks containing black ink, cyan ink, magenta ink, and yellow ink, respectively, are stored in a lower portion of the ink tank cover 2. These ink tanks can be replaced independently of each other.

A print medium, for example, a roll paper having a width of 10 inches to 40 inches is mounted in correspondence with the printing width of the printhead in the printing apparatus 1, and printing can be performed by conveying the print medium to a printing region of the printhead.

Note that as shown in FIG. 1, the print medium which is like a continuous roll paper can be stored in two stages (an upper roll paper fixing unit 4*a* and a lower roll paper fixing unit 4*b*), and printing can be performed on either attached roll paper. Note that FIG. 1 shows a state in which roll paper R has been attached to the lower roll paper fixing unit 4*b*.

The structure of the printhead will be described in detail next.

<Description of Arrangement of Printhead (FIG. 2)>

Figure 2:
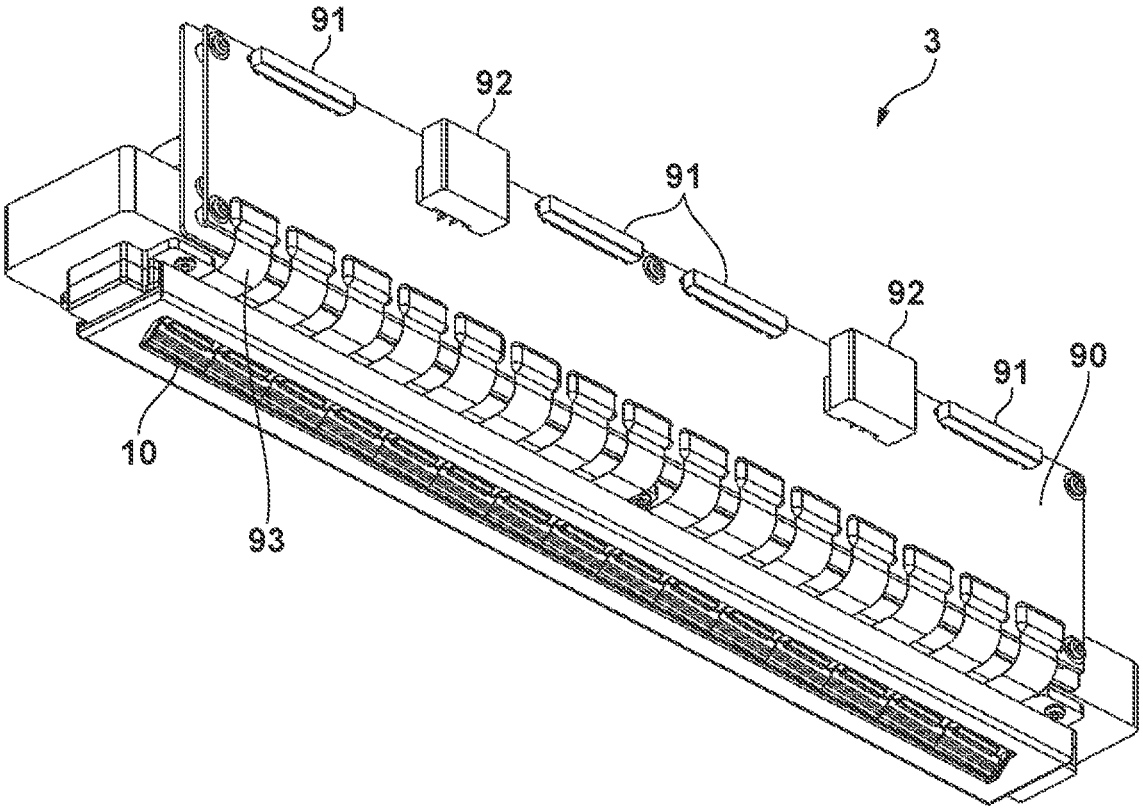
FIG. 2 is a perspective view showing the schematic arrangement of a printhead.

FIG. 2 is a perspective view showing the schematic arrangement of a printhead 3. The printhead 3 is a line printhead in which 15 element substrates 10 that can discharge four color inks of C/M/Y/K have been linearly arranged (arranged in line). Note that other than this kind of an arrangement, four printheads 3, each configured to discharge one color ink, may be arranged in the conveyance direction of the print medium so as to discharge four color inks of C/M/Y/K.

As shown in FIG. 2, the printhead 3 includes signal input terminals 91, each electrically connected to a corresponding element substrate 10 via a flexible wiring substrate 93 and an electric wiring substrate 90, and power supply terminals 92. Each signal input terminal 91 and each power supply terminals 92 are electrically connected to a control unit of the printing apparatus 1 and supply a discharge driving signal and power, respectively, necessary for discharge to the corresponding element substrate 10. By integrating the wiring lines by an electric circuit in the electric wiring substrate 90, the number of the signal input terminals 91 and the number of the power supply terminals 92 can be less than the number of the element substrates 10. As a result, fewer electrical connection portions will be needed when the printhead 3 is to be attached to the printing apparatus 1 or when the printhead is to be replaced.

Electrothermal transducers (heaters) (not shown) are formed in correspondence with the respective orifices on each element substrate 10. Each electrothermal transducer causes ink to bubble by energizing and applying heat and causes the ink to be discharged from the orifice by this bubbling energy.

<Description of Control Arrangement (FIG. 3)>

Figure 3:
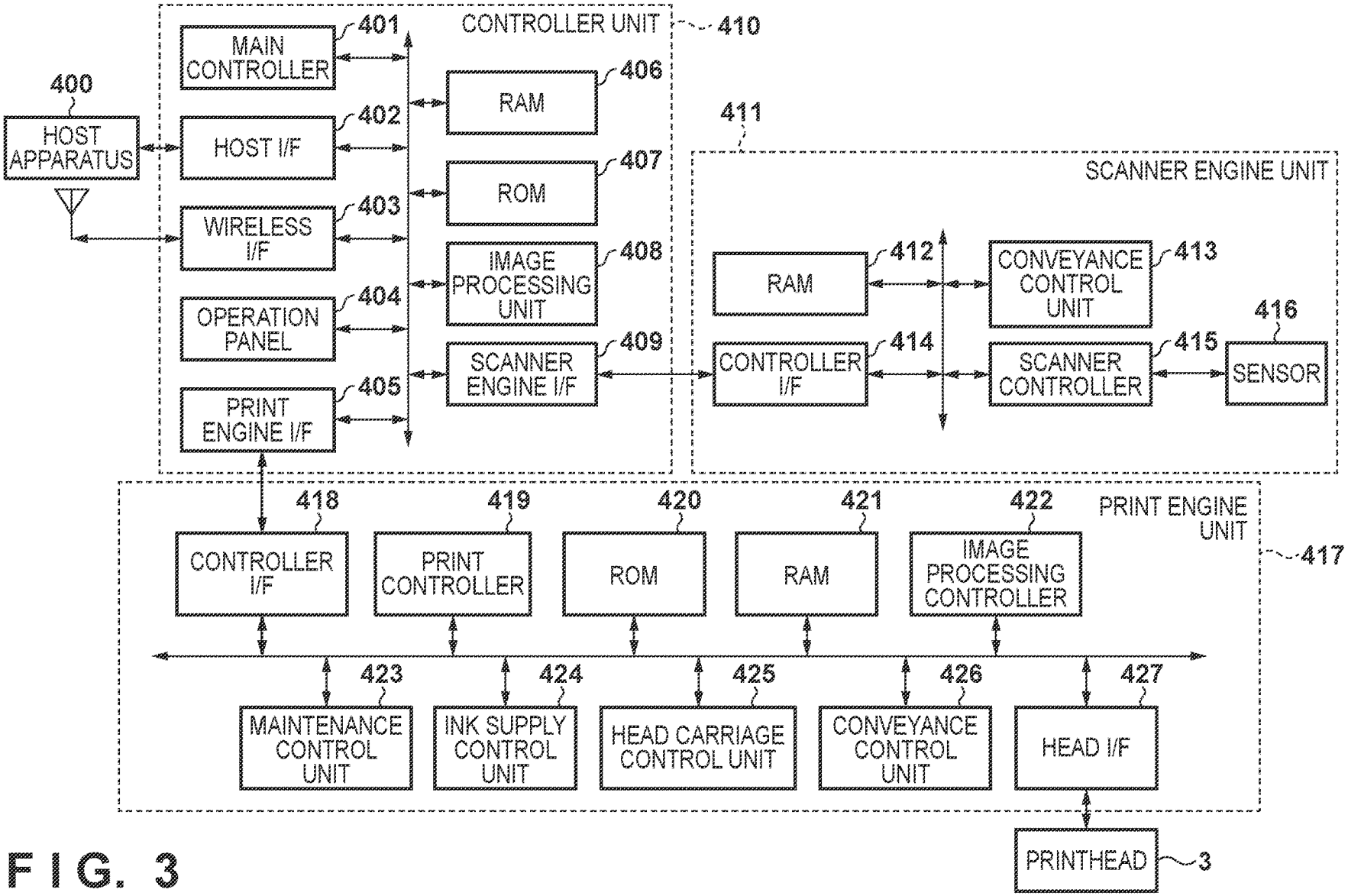
FIG. 3 is a block diagram showing the control arrangement of the printing apparatus shown in FIG. 1.

FIG. 3 is a block diagram showing the arrangement of a control circuit of the printing apparatus 1.

As shown in FIG. 3, the printing apparatus 1 is formed by a print engine unit 417 which mainly controls a printing unit, a scanner engine unit 411 which mainly controls a scanner unit, and a controller unit 410 which controls the entire printing apparatus 1. A print controller 419 incorporating an MPU and a nonvolatile memory (EEPROM or the like) controls various kinds of mechanisms of the print engine unit 417 in accordance with instructions from a main controller 401 of the controller unit 410. The various kinds of mechanisms of the scanner engine unit 411 are controlled by the main controller 401 of the controller unit 410.

The control arrangement will be described in detail hereinafter.

In the controller unit 410, the main controller 401 which is formed by a CPU controls, by using a RAM 406 as a work area, the entire printing apparatus 1 in accordance with programs and various kinds of parameters stored in a ROM 407. For example, when a print job is input from a host apparatus 400 via a host I/F 402 or a wireless I/F 403, an image processing unit 408 will execute, in accordance with the instruction from the main controller 401, predetermined image processing on the received image data. The main controller 401 will subsequently transmit the image data that has undergone the image processing to the print engine unit 417 via a print engine I/F 405.

Note that the printing apparatus 1 may obtain the image data from the host apparatus 400 via wireless communication or wired communication or may obtain the image data from an external storage device (a USB memory or the like) connected to the printing apparatus 1. The communication method used in the wireless communication or the wired communication is not limited. For example, Wi-Fi® (Wireless Fidelity®) or Bluetooth® can be applied as the communication method to be used in the wireless communication. Also, a USB (Universal Serial Bus) or the like can be applied as the communication to be used in the wired communication. In addition, for example, when a read command is input from the host apparatus 400, the main controller 401 will transmit this command to the scanner engine unit 411 via a scanner engine I/F 409.

An operation panel 404 is a unit for a user to perform input/output on the printing apparatus 1. The user can instruct operations such as copying, scanning, and the like, set a print mode, and recognize information of the printing apparatus 1 via the operation panel 404.

In the print engine unit 417, the print controller 419 formed by a CPU controls, by using a RAM 421 as a work area, the various kinds of mechanisms of the print engine unit 417 in accordance with programs and various kinds of parameters stored in a ROM 420.

When various kinds of commands or image data is received via a controller I/F 418, the print controller 419 will temporarily store the received command or image data in the RAM 421. The print controller 419 causes an image processing controller 422 to convert the stored image data into print data so that the printhead 3 can use the print data during a printing operation. When the print data is generated, the print controller 419 causes, via a head I/F 427, the printhead 3 to execute a printing operation based on the print data. During this time, the print controller 419 drives conveyance roller 28 via a conveyance control unit 426 to convey a print medium. In accordance with the instruction of the print controller 419, the printing operation by the printhead 3 is executed in synchronization with the conveyance operation of the print medium, thereby executing the printing processing.

A head carriage control unit 425 changes the direction and the position of the printhead 3 in accordance with an operation state such as a maintenance state or a print state of the printing apparatus 1. An ink supply control unit 424 controls a liquid supplying unit (not shown) so that the pressure of the ink to be supplied to the printhead 3 will be contained within an appropriate range. A maintenance control unit 423 controls the operation of a cap unit and a wiping unit in a maintenance unit (not shown) when a maintenance operation is to be performed on the printhead 3.

In the scanner engine unit 411, the main controller 401 controls, by using the RAM 406 as a work area, hardware resources of a scanner controller 415 in accordance with programs and various kinds of parameters stored in the ROM 407. As a result, the various kinds of mechanisms included in the scanner engine unit 411 are controlled. For example, the main controller 401 can control, via a controller I/F 414, the hardware resources in the scanner controller 415 to convey, to a conveyance control unit 413, an original stacked on an ADF (not shown) by the user, and read the original by a sensor 416. Subsequently, the scanner controller 415 will store the read image data in a RAM 412.

Note that the print controller 419 can convert the image data that has been obtained as described above into print data to cause the printhead 3 to execute a printing operation based on the image data read by the scanner controller 415.

<Description of Conveyance Arrangement of Roll Paper (FIG. 4)>

Figure 4:
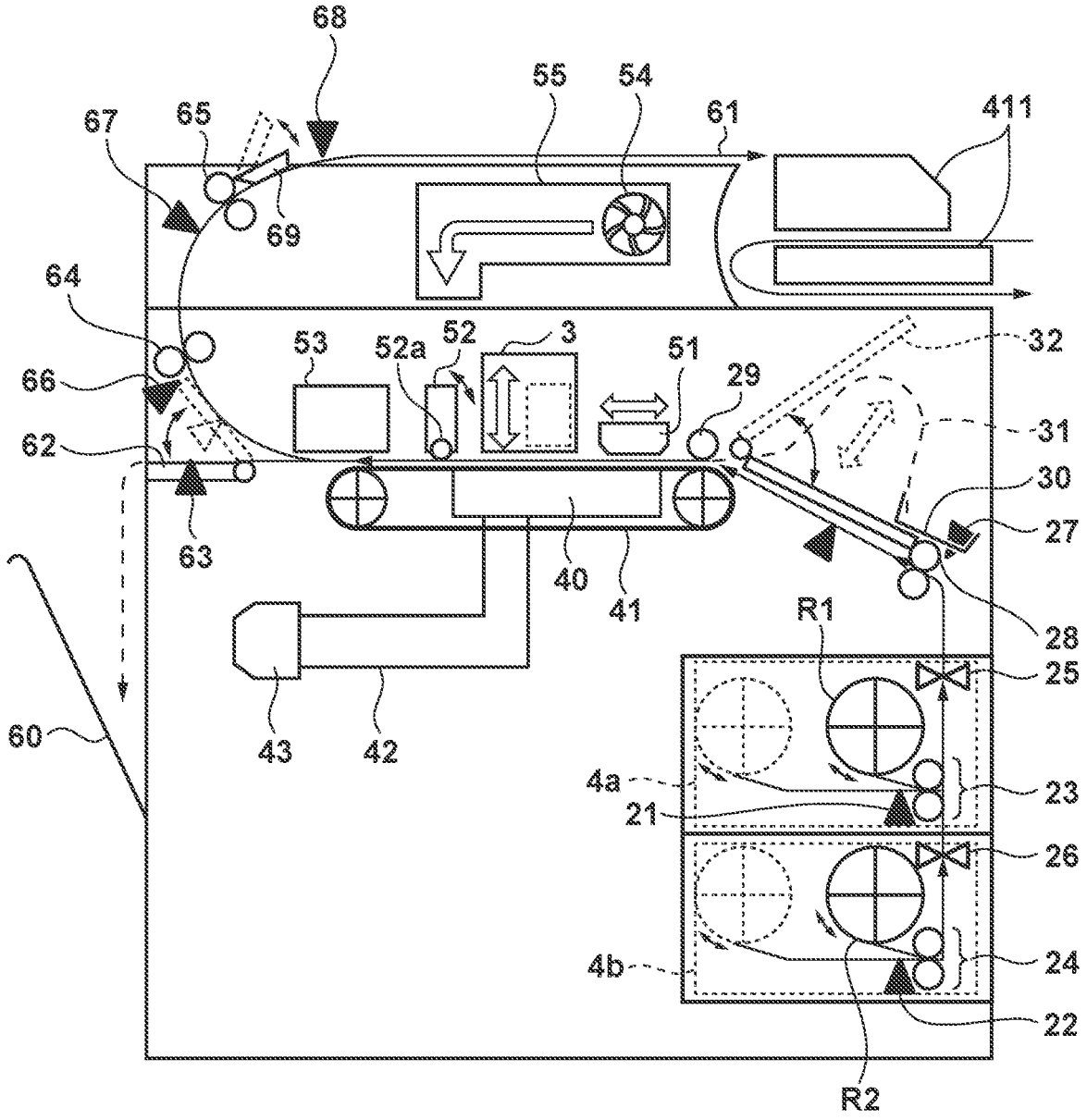
FIG. 4 is a view showing the outline of a side section of the printing apparatus shown in FIG. 1 and schematically shows the conveyance arrangement of roll paper.

FIG. 4 is a side sectional view of the printing apparatus 1 shown in FIG. 1, and schematically shows the conveyance arrangement of roll paper. FIG. 4 shows a state in which roll paper R1 is mounted to the roll paper fixing unit 4*a* and roll paper R2 is mounted to the roll paper fixing unit 4*b*. When the user mounts the roll paper R1 to a portion indicated by broken lines of the roll paper fixing unit 4*a* in FIG. 4, the roll paper R1 rotates and moves to a hatched portion to be fixed and attached to the printing apparatus. In a similar manner, when the user mounts the roll paper R2 to a portion indicated by broken lines of the roll paper fixing unit 4*b*, the roll paper R2 rotates and moves to a hatched portion to be fixed and attached to the printing apparatus.

In FIG. 4, the roll paper fixing unit 4*a* includes a holding unit for holding the roll paper R1, a feeder sensor 21, a pair of feeding rollers 23, and a cutter 25. In a similar manner, the roll paper fixing unit 4*b* includes a holding unit for holding the roll paper R2, a feeder sensor 22, a pair of feeding rollers 24, and a cutter 26.

The cutter 25 is a cutting unit that can cut the roll paper R1 fed from the roll paper fixing unit 4*a* and cut the roll paper R2 fed from the roll paper fixing unit 4*b*. The cutter 26 is a cutting unit that can cut the roll paper R2 fed from the roll paper fixing unit 4*b*. The pair of feeding rollers 23 and the pair of feeding rollers 24 operate as conveyance units that convey the roll paper R1 and the roll paper R2, respectively, to the conveyance rollers 28.

For example, when a feeding motor (not shown) attached to a rotation shaft of the roll paper fixing unit 4*a* is driven to print an image on the roll paper R1, the leading edge is fed out and is nipped by a pair of feeding rollers 23 when the leading edge is detected by a feeder sensor 21. Subsequently, the leading edge of the roll paper R1 is further conveyed by the rotation of the pair of feeding rollers 23, and the leading edge of the roll paper R1 is cut by a cutter 25 to trim the shape of the roll paper R1.

In a similar manner, when a feeding motor (not shown) attached to a rotation shaft of the roll paper fixing unit 4*b* is driven to print an image on the roll paper R2, the leading edge is fed out and is nipped by a pair of feeding rollers 24 when the leading edge is detected by a feeder sensor 22. Subsequently, the leading edge of the roll paper R2 is further conveyed by the rotation of the pair of feeding rollers 24, and the leading edge of the roll paper R2 is cut by a cutter 26 to trim the shape of the roll paper R2.

The roll paper whose leading edge has been trimmed by either the cutter 25 or 26 is further conveyed in the direction of an arrow. When the leading edge of the roll paper is detected by a leading edge detection sensor 27, the conveyance rollers are driven to start the rotation. Subsequently, the roll paper whose leading edge has been nipped by conveyance rollers 28 is further conveyed and reaches a LF roller 29. The LF roller 29 is a conveyance roller closest to the printing unit 3 among the plurality of rollers arranged between the printing unit 3 and the roll paper fixing unit. When the leading edge of the roll paper is nipped by the LF roller 29, the conveyance of the roll paper will be performed by the LF roller 29 and the conveyance rollers 28, and the roll paper will be conveyed on a conveyance belt 41. Note that a fixing guide 30 is arranged near the leading edge detection sensor 27 to support the smooth conveyance of the roll paper.

At this time, a loop 31, as indicated by broken lines in FIG. 4, will be formed by the roll paper when control is performed to slightly change a rotation speed V0 of the LF roller 29 and a rotation speed V of the conveyance rollers 28 from each other so that the rotation speed V will be slightly higher than the rotation speed V0. A flapper 32, whose one end is fixed and is set to be rotatable by using this fixed portion as a rotation shaft, is configured to rotate in accordance with the formation of the loop 31 so as not to hinder the roll paper from being formed into a loop.

The roll paper will be further conveyed in this state and reach a printing position between the lower portion of the printhead 3 and a platen 40.

As shown in FIG. 4, the platen 40 is arranged, with respect to the conveyance direction of the roll paper, in the lower portion of the conveyance belt 41 for conveying the roll paper between the upstream side and the downstream side of the printhead 3, and the platen 40 is connected to a suction fan 43 via a duct 42. This kind of arrangement can prevent the roll paper from floating during the conveyance by causing the roll paper to be adhere to the conveyance belt 41 through the holes provided on the platen 40 by operating the suction fan 43 to generate a negative pressure by suctioning the air inside the duct 42.

In addition, in the conveyance direction of the roll paper, a recovery unit 51 is arranged on the upstream side and a cap 52 and a drying unit 53 are arranged on the downstream side of the printhead 3. As shown in FIG. 4, the recovery unit 51 can move the roll paper in the conveyance direction, and the cap 52 is configured to be rotatable about a rotation shaft 52*a*. Furthermore, as described above, the printhead 3 has a print width corresponding to the width of the roll paper as a print medium. Although the printhead 3 will be fixed during printing, it is configured to be movable in a vertical direction as shown by an arrow in FIG. 4 in cases other than the printing operation.

In a case in which, for example, the discharge state of the printhead 3 is to be recovered by such an arrangement, the printhead 3 will be moved upward, and the recovery unit 51 will move to the space created by this upward movement. Subsequently, the recovery unit 51 will execute a recovery operation by wiping an ink discharge surface of the printhead 3, suctioning the orifices, causing the printhead 3 to execute a preliminary discharge, and the like. Note that since these operations are well-known techniques, a description of these operations will be omitted.

On the other hand, in order to prevent the drying of the ink discharge surface of the printhead 3 in a case in which neither a printing operation nor a recovery operation is to be performed, the printhead 3 will be moved upward and the cap 52 will be rotated into the space created by this upward movement. Subsequently, the printhead 3 will be moved in downward so that the printhead 3 will be capped by the cap 52.

In addition, the drying unit 53 is operated to heat the surface of the roll paper to dry the roll paper when the printhead 3 has completed printing by discharging ink. This will prevent a state in which the inside of the apparatus (particularly, the conveyance path of the roll paper) will become contaminated with ink when wet roll paper is further conveyed after printing. Furthermore, a fan 54 and a duct 55 are arranged on the upper portion of the printhead 3. The fan 54 can be operated to blow external air via the duct 55 in the direction of an arrow, and this air will promote the drying of the printed roll paper.

A printing length L in the conveyance direction of the roll paper can be set based on either a user instruction from the operation panel 100 or an instruction from the host apparatus 400. When the roll paper whose leading edge has been trimmed by one of the cutters 25 and 26 is confirmed to have been conveyed from this leading edge up to the printing length L, the trailing edge of the roll paper is cut by the corresponding one of the cutters 25 and 26. An example of the control for cutting the trailing edge of the roll paper will be described in detail later.

The roll paper (to be referred to as cut paper hereinafter) that has been printed by the printhead 3 and whose trailing edge has been cut is discharged to a back basket 60 or a front stacker 61. The selection of the discharge location can be made based on either a user instruction from the operation panel 100 or an instruction from the host apparatus 400.

In a case in which the cut paper is to be discharged to the back basket 60, a flapper 62 will be rotated to form a conveyance path in the direction of the back basket 60. As a result, the cut paper will be conveyed by the rotation of the conveyance belt 41 and drop into the back basket 60 as indicated by broken lines in FIG. 4. Note that the leading edge detection, the passing, and the trailing edge detection of the cut paper will be performed based an output signal from a paper sensor 63.

In contrast, in a case in which the cut paper is to be discharged to the front stacker 61, the flapper 62 will be rotated and positioned in the location indicated by fine broken lines to form a conveyance path in the direction of the front stacker 61. As a result, the cut paper will be conveyed by the rotation of the conveyance belt 41, reach a pair of paper discharge rollers 64, further reach a pair of paper discharge rollers 65, and finally be discharged to the front stacker 61. Note that paper sensors 66 and 67 and a paper discharge sensor 68 are arranged in the conveyance path to the front stacker 61 so that the discharge state of the cut paper will be detected. In addition, a trailing edge pressing lever 69 will be arranged between the pair of paper discharge rollers 65 and the paper discharge sensor 68 to prevent the trailing edge of the cut paper from jumping and to support the smooth discharge of the cut paper.

Note that the scanner engine unit 411 will read an image when the user inserts an original of the image in the direction of a solid line arrow. However, since a conventional arrangement is used as the arrangement of the scanner engine unit 411, a description will be omitted here.

Next, an example of the control of the cutters 25 and 26 that is to be executed by a printing apparatus which has the above arrangement will be described in detail hereinafter.

Figure 5:
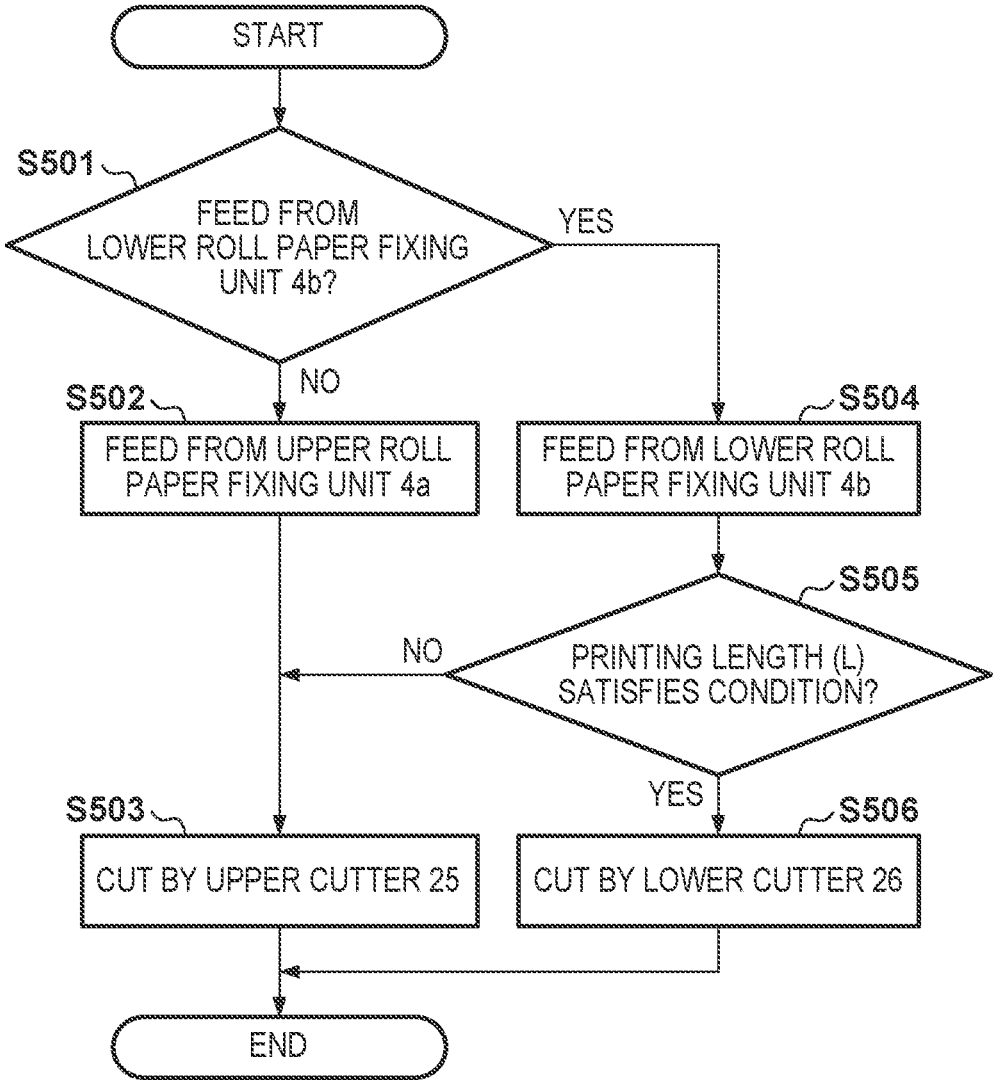
FIG. 5 is a flowchart showing an example of processing executed by a printing apparatus according to the first embodiment.

First Embodiment (FIG. 5)

FIG. 5 is a flowchart showing an example of processing executed by the printing apparatus 1. In this embodiment, although the processing of the flowchart shown in FIG. 5 will be described as processing to be executed by a conveyance control unit 426 in response to receiving a print job (printing instruction) from a host apparatus 400, a main controller 401, a print controller 419, or the like may also execute the processing. Note that although a printing operation by a printing unit 3 can be performed appropriately while the processing of this flowchart is being executed, a description of this printing operation will be omitted below.

First, in step S501, the conveyance control unit 426 determines which of an upper roll paper fixing unit 4*a* and a lower roll paper fixing unit 4*b* will be used to feed paper. In this embodiment, the conveyance control unit 426 will determine which roll paper fixing unit to designate based on information for designating one of the upper roll paper fixing unit 4*a* and the roll paper fixing unit 4*b* included in the print job input from the host apparatus 400.

Note that in one example, in step S501, it may be determined that paper will be fed from the lower roll paper fixing unit 4*b* in a case in which a dimension L in the conveyance direction of a product determined based on the print job input from the host apparatus 400 is larger than a threshold. In this embodiment, the dimension in the conveyance direction of the product includes, for example, a length in the conveyance direction of the product, a length (printing length) in the conveyance direction of an image to be printed on a sheet on the product, and a length, such as a sheet size designated in the print job or the like, in the conveyance direction of the product. In a case in which a margin is to be designated in the print job, the length in the conveyance direction of the product can include, in addition to the printing length, the length in the conveyance direction of the margin arranged at each of the leading edge and the trailing edge of the product in the conveyance direction. A case in which the printing length is the dimension L in the conveyance direction of the product will be described hereinafter. For example, in a case in which the printing length L is greater than a total of a path length L1 of a conveyance path from an LF roller 29 to conveyance rollers 28 and a path length L2 of a conveyance path from the conveyance rollers 28 to a lower cutter 26, the conveyance control unit can determine to feed paper from the lower roll paper fixing unit 4*b*. Alternatively, in a case in which the printing length L is greater than the path length L2, the conveyance control unit may determine to feed paper from the lower roll paper fixing unit 4*b*. Alternatively, in a case in which information related to the sheet size is included in the print job input from the host apparatus 400, the conveyance control unit may determine to feed paper from the lower roll paper fixing unit 4*b* when the information indicates one of the plurality of sheet sizes such as A0, A1, and the like.

In a case in which paper feeding is not to be performed from the lower roll paper fixing unit 4*b* (NO in step S501), the conveyance control unit 426 will advance the process to step S502 and feed paper from the upper roll paper fixing unit 4*a*. Note that in step S502, a pair of upper feeding rollers 23 may be controlled to convey upper roll paper R1, and an upper cutter 25 may be used to perform trimming to cut the leading edge of the roll paper R1. Next, the conveyance control unit 426 drives the pair of upper feeding rollers 23 to convey the roll paper R1 to the conveyance rollers 28. Subsequently, when it is confirmed that the roll paper has been conveyed so that the length from the leading edge of the roll paper R1 to the upper cutter 25 has reached the printing length L, the conveyance control unit 426 will advance the process to step S503 and control the cutter 25 to cut the roll paper R1. Subsequently, the printing apparatus 1 prints on the cut roll paper R1, and the processing of FIG. 5 ends.

On the other hand, in a case in which paper feeding is to be performed from the lower roll paper fixing unit 4*b* (YES in step S501), the conveyance control unit 426 will advance the process to step S504 and start feeding paper from the lower roll paper fixing unit 4*b*. Next, the conveyance control unit 426 advances the process to step S505, and determines whether the printing length L satisfies a predetermined condition.

The predetermined condition may be a state in which the printing length L is longer than a conveyance path length from the LF roller 29 to the lower cutter 26. That is, the predetermined condition may be a state in which the printing length L is longer than the total of the length from the LF roller 29 to the conveyance rollers 28 and the length from the conveyance rollers 28 to the lower cutter 26. Alternatively, the predetermined condition may be a state in which the printing length L is longer than a total of a length of a loop 31 and the length from the conveyance rollers 28 to the lower cutter 26.

Alternatively, the predetermined condition may be, for example, a state in which the printing length L is longer than the length of the conveyance path from the conveyance rollers 28 to the lower cutter 26. In this case, even if roll paper R2 is cut by the cutter 26, it will be possible to continue the conveyance of the roll paper by nipping the roll paper R2 by the conveyance rollers 28. Note that in a case in which an additional conveyance roller is present on the conveyance path from the conveyance rollers 28 to the upper cutter 25, the predetermined condition may be set based on whether the length of the conveyance path from this additional conveyance roller to the lower cutter 26 is longer than the printing length L.

Note that in step S505, whether the sheet size designated in the print job input from the host apparatus 400 satisfies a predetermined condition may be determined. For example, the predetermined condition may be a state in which the sheet size designated in the print job is one of A0, A1, A2, B0, B1, B2, and B3. Alternatively, whether the printing length L is greater than one of the dimensions (for example, 841 mm which is the dimension of a long side of A1) of the plurality of sheet sizes may be determined.

Alternatively, in step S505, whether the sheet size and the printing orientation designated in the print job input from the host apparatus 400 satisfy a predetermined condition may be determined. For example, the predetermined condition may be a state in which the combination of the sheet size and the printing orientation designated in the print job is one of A0 portrait, A0 landscape, A1 portrait, B0 portrait, B0 landscape, and B1 portrait.

If it is determined that the printing length L does not satisfy the predetermined condition in step S505 (NO in step S505), the conveyance control unit 426 will advance the process to step S503, convey the lower roll paper R2, and use the upper cutter 25 to cut the roll paper R2. As a result, since the upper cutter 25 which has a shorter conveyance path length to the conveyance rollers 28 will be used to cut the roll paper R2 when the printing length L is short, it will be possible for the conveyance rollers 28 to nip the roll paper R2 even in a case in which the printing length L is short.

If it is determined in step S505 that the printing length L satisfies the predetermined condition (YES in step S505), the conveyance control unit 426 will advance the process to step S506, control a pair of lower feeding rollers 24 to convey the lower roll paper R2, and use the lower cutter 26 to cut the leading edge of the roll paper R2. Next, when the conveyance control unit 426 drives the pair of lower feeding rollers 24 to convey the roll paper R2 to the conveyance rollers 28 and confirms that the length from the leading edge of the roll paper R2 to the lower cutter 26 has reached the printing length L, the roll paper R2 is cut by the cutter 26. Subsequently, the printing apparatus 1 prints on the cut roll paper R2, and the processing of FIG. 5 ends.

Note that in step S501, the conveyance control unit 426 may feed paper from the lower roll paper R2 and determine whether the received print job can be executed. For example, the conveyance control unit may determine that the received print job can be executed by feeding paper from the lower roll paper R2 in a case in which the sheet width of the lower roll paper R2 matches the sheet width designated in the received print job. In another example, the conveyance control unit may determine that the received print job can be executed by feeding paper from the lower roll paper R2 in a case in which the combination of the sheet width and the sheet type of the lower roll paper R2 matches the combination of the sheet width and the sheet type designated in the print job.

As a result, since paper will be fed from the lower roll paper fixing unit 4*b* in a case in which paper feeding can be performed from the lower roll paper fixing unit 4*b*, the possibility that cutting will be performed by the lower cutter 26 can be increased, and the usage frequency of the cutter can be more dispersed.

Figure 6:
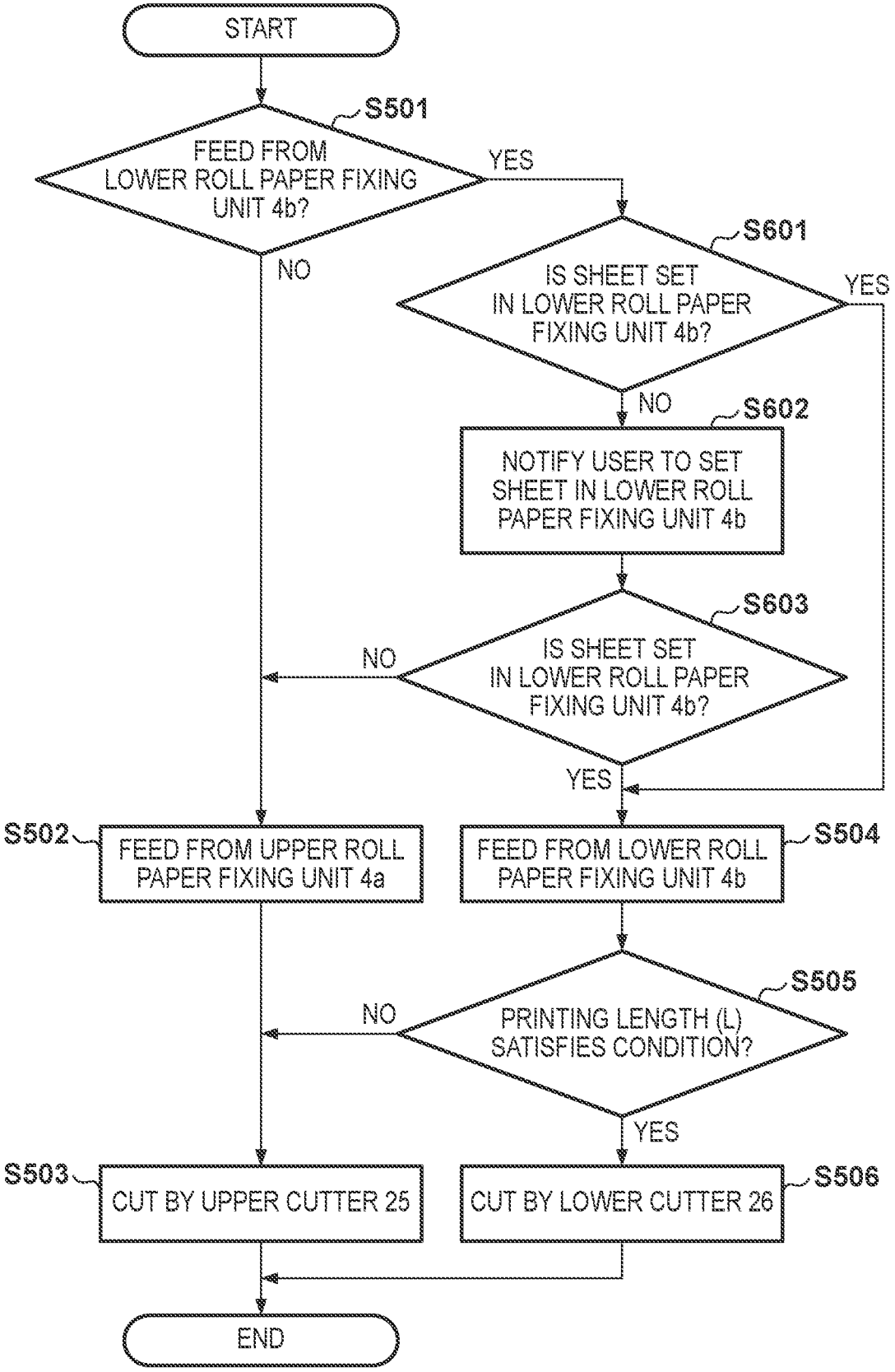
FIG. 6 is a flowchart showing an example of processing executed by a printing apparatus according to the second embodiment.

Second Embodiment (FIG. 6)

FIG. 6 is a flowchart showing an example of processing to be executed by a printing apparatus 1. In this embodiment, although the processing of the flowchart shown in FIG. 6 will be described as processing to be executed by a conveyance control unit 426 in response to receiving a print job (printing instruction) from a host apparatus 400, a main controller 401, a print controller 419, or the like may also execute the processing. Note that although a printing operation by a printing unit 3 can be performed appropriately while the processing of this flowchart is being executed, a description of this printing operation will be omitted below. Also, same reference symbols will be used to denote processes similar to those of the first embodiment, and a description thereof will be omitted.

In step S501, if the conveyance control unit 426 determines to feed paper from a lower roll paper fixing unit 4*b* (YES in step S501), the conveyance control unit 426 will advance the process to step S601. If the conveyance control unit 426 determines not to feed paper from the lower roll paper fixing unit 4*b* (NO in step S501), the conveyance control unit 426 will advance the process to step S502.

In step S601, the conveyance control unit 426 determines whether a sheet is set in the lower roll paper fixing unit 4*b*. For example, the conveyance control unit 426 determines, based on an output from a feeder sensor 22, whether a sheet is already set in the lower roll paper fixing unit 4*b*. In another example, the lower roll paper fixing unit 4*b* may include a pressure sensitive sensor (not shown) and determine whether a sheet is already set by comparing an output from the pressure sensitive sensor when a sheet is not set in the lower roll paper fixing unit 4*b* and an output from the pressure sensitive sensor when the process of step S601 is to be executed. If a sheet is set in the lower roll paper fixing unit 4*b* (YES in step S601), the conveyance control unit 426 advances the process to step S504. If a sheet is not set in the lower roll paper fixing unit 4*b* (NO in step S601), the conveyance control unit 426 advances the process to step S602 and notifies a user to set a sheet in the lower roll paper fixing unit 4*b*. For example, the conveyance control unit 426 can perform the notification by displaying a message "please set a roll sheet in the lower stage" on a display (notification unit) of an operation panel 404.

Next, the conveyance control unit 426 advances the process to step S603, and determines whether a sheet has been set in the lower roll paper fixing unit 4*b*. Since the process of step S603 is similar to the process of step S601, a description will be omitted. If the conveyance control unit 426 determines that the sheet has been set to the lower roll paper fixing unit 4*b* (YES in step S603), the process advances to step S504. If it is determined that the sheet has not been set to the lower roll paper fixing unit 4*b* (NO in step S603), the process advances to step S502. Since the processes of step S502 to step S506 are similar to the processes of the first embodiment, a description will be omitted.

As described above, the printing apparatus according to this embodiment will notify the user to set a sheet to the lower roll paper fixing unit when paper is to be fed from the lower roll paper fixing unit. As a result, since the user will be prompted to execute sheet feeding from the lower roll paper fixing unit, it will be possible to disperse the usage frequency of the upper cutter and the usage frequency of the lower cutter.

This embodiment described that each roll paper fixing unit will include a cutter. However, a cutter may be arranged separately from the roll paper fixing unit.

In addition, this embodiment described a printing apparatus that includes two cutters (cutters 25 and 26) and two roll paper fixing units (roll paper fixing units 4*a* and 4*b*). However, it is sufficient as long as a plurality of cutters and a plurality of roll paper fixing units are included. In addition, the number of cutters may be different from the number of the roll paper fixing units. For example, the printing apparatus may include an upper roll paper fixing unit, a middle roll paper fixing unit, and a lower roll paper fixing unit, and include a first cutter and a second cutter in the upper roll paper fixing unit and the middle roll paper fixing unit, respectively, but not include a cutter in the lower roll paper fixing unit. In this case, it may be arranged so that the first cutter can cut the roll paper fed from the upper, middle, and lower roll paper fixing units, and the second cutter can cut the roll paper fed from the middle and lower roll paper fixing units.

Other Embodiments

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-089932, filed on May 22, 2020, which is hereby incorporated by reference herein in its entirety.

What is claimed is:

1. A printing apparatus having a printing unit, the printing apparatus comprising:

a first holding unit configured to hold a sheet;

a conveyance unit configured to convey the sheet to the printing unit;

a first cutting unit arranged between the printing unit and the first holding unit and configured to cut the sheet fed from the first holding unit;

a second cutting unit arranged between the printing unit and the first cutting unit and configured to cut the sheet fed from the first holding unit; and a control unit configured to determine, in accordance with a length in a conveyance direction of a product to be printed on the sheet by the printing unit, whether to cut the sheet fed from the first holding unit by the first cutting unit or the second cutting unit.

2. The printing apparatus according to claim 1, further comprising a second holding unit configured to hold the sheet at a position different from the first holding unit, wherein the control unit controls the second cutting unit so as to cut the sheet fed from the second holding unit.

3. The printing apparatus according to claim 2, wherein the control unit controls the first cutting unit and the second cutting unit so that trimming of a leading edge of the sheet fed from the first holding unit will be performed by the first cutting unit and trimming of a leading edge of the sheet fed from the second holding unit will be performed by the second cutting unit.

4. The printing apparatus according to claim 2, wherein, when accepting a printing instruction, the control unit determines whether to print on the sheet fed from the first holding unit, and controls the conveyance unit to feed the sheet fed from the first holding unit in accordance with the determination.

5. The printing apparatus according to claim 4, further comprising a notification unit configured to perform notification to prompt a user to set a sheet to the first holding unit in a case in which the control unit has determined to print on the sheet fed from the first holding unit.

6. The printing apparatus according to claim 1, wherein, in a case in which the length in the conveyance direction of the product is greater than a length of a conveyance path from the first cutting unit to the conveyance unit, the first cutting unit is controlled so that the first cutting unit will cut the sheet fed from the first holding unit.

7. The printing apparatus according to claim 6, wherein the conveyance unit includes a plurality of conveyance rollers, and wherein, in a case in which the length in the conveyance direction of the product is greater than a length of a conveyance path from the first cutting unit to a conveyance roller closest to the printing unit, the first cutting unit is controlled so that the first cutting unit will cut the sheet fed from the first holding unit.

8. The printing apparatus according to claim 7, wherein the length of the conveyance path from the first cutting unit to the conveyance roller closest to the printing unit is a length of a conveyance path from the first cutting unit to the conveyance roller closest to the printing unit including a loop of the sheet formed between the conveyance roller and the first cutting unit.

9. The printing apparatus according to claim 1, wherein, in a case in which the length in the conveyance direction of the product is greater than a dimension of one of a plurality of sheet sizes, the first cutting unit is controlled so that the first cutting unit will cut the sheet fed from the first holding unit.

10. A printing apparatus comprising:

a first storing unit;

a second storing unit;

a conveyance unit;

a control unit; and a printing unit, wherein the first storing unit includes a first holding unit configured to hold a sheet, and includes a first cutting unit, where the first cutting unit is arranged between the printing unit and the first holding unit and is configured to cut the sheet fed from the first holding unit, wherein the second storing unit includes a second holding unit configured to hold a sheet, and includes a second cutting unit, where the second cutting unit is arranged between the printing unit and the first cutting unit and configured to cut the sheet fed from the first holding unit and the sheet fed from the second holding unit, wherein the conveyance unit is configured to convey, to the printing unit, one sheet fed from the first holding unit and the sheet fed from the second holding unit, and wherein, in a case in which the sheet is to be fed from the first holding unit, the control unit determines, in accordance with a length in a conveyance direction of a product, whether to cut the sheet fed from the first holding unit by the first cutting unit or the second cutting unit.

* * * * *